US007929886B2

(12) United States Patent
Yoshizawa et al.

(10) Patent No.: US 7,929,886 B2
(45) Date of Patent: Apr. 19, 2011

(54) TONER CARTRIDGE HAVING A DIVIDER PLATE TO PREVENT EXCESSIVE REFILLING

(75) Inventors: Kyoichi Yoshizawa, Nagoya (JP); Yukio Yamada, Toyokawa (JP); Koji Soda, Toyokawa (JP); Hideaki Katsuoka, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 174 days.

(21) Appl. No.: 12/246,305

(22) Filed: Oct. 6, 2008

(65) Prior Publication Data

US 2009/0097886 A1 Apr. 16, 2009

(30) Foreign Application Priority Data

Oct. 16, 2007 (JP) ..... 2007-268729

(51) Int. Cl.
*G03G 15/08* (2006.01)

(52) U.S. Cl. ..... 399/263; 399/260

(58) Field of Classification Search ..... 399/262, 399/260, 263

See application file for complete search history.

(56) References Cited

FOREIGN PATENT DOCUMENTS

| | | | |
|---|---|---|---|
| JP | 61-160457 | | 10/1986 |
| JP | 01090471 A | * | 4/1989 |
| JP | 3-210583 | | 9/1991 |
| JP | 3-273272 | | 12/1991 |
| JP | 4-340986 | | 11/1992 |
| JP | 05046025 A | * | 2/1993 |
| JP | 5-249766 | | 9/1993 |
| JP | 7-56430 | | 3/1995 |
| JP | 7-175305 | | 7/1995 |
| JP | 8-211717 | | 8/1996 |
| JP | 11-167287 | | 6/1999 |
| JP | 2002-296904 | | 10/2002 |

OTHER PUBLICATIONS

Japanese Notice of Reason for Rejection dated Oct. 27, 2009, directed towards counterpart JP Application No. 2007-268729; 5 pages.

Japanese Office Action mailed on Jul. 28, 2009 directed to counterpart application No. 2007-268729; 4 pages.

Chinese Office Action dated Apr. 26, 2010, directed to corresponding Chinese Patent Application No. 200810170232.6; 8 pages.

Japanese Notice of Reason for Rejection mailed on Feb. 22, 2010 directed at application No. 2007-268729; 4 pages.

* cited by examiner

*Primary Examiner* — Susan S Lee
(74) *Attorney, Agent, or Firm* — Morrison & Foerster LLP

(57) ABSTRACT

A toner cartridge includes, a housing which forms an internal space for housing toner to be fed to an image forming apparatus and which has a filling port for filling the internal space with the toner, a divider plate which is movably provided in the housing so as to be able to divide the internal space, and a fixing portion which can fix the divider plate in a state of dividing the internal space.

8 Claims, 5 Drawing Sheets

TONER CARTRIDGE HAVING A DIVIDER PLATE TO PREVENT EXCESSIVE REFILLING

This application is based on application No. 2007-268729 filed in Japan, the contents of which are hereby incorporated by reference.

BACKGROUND OF THE INVENTION

The present invention relates to a toner cartridge.

Toner cartridges for feeding toner to image forming apparatuses are so designed that the lifetime of consumable items such as sealing members may be sufficiently long compared to the filling amount of the toner. However, since excessively lengthening the lifetime of consumable items causes cost increase, the consumable items of toner cartridges such as sealing members and developing rollers are often set to have the lifetime about 1.5 times to 2 times the filling amount of toner.

Used toner cartridges may be collected and filled with new toner for recycling, and in such cases, toner is often fully refilled without taking into consideration the lifetime of the consumable items of the toner cartridge. Accordingly, consumable items of the recycled toner cartridges may suffer excessive wear, which may lead to deterioration of the imaging quality, taint damage of image forming apparatuses due to toner leakage, and failures such as breakage of image forming apparatuses. In toner cartridges having a developing roller in particular, deterioration of the imaging quality by wear of the developing roller poses a large problem.

SUMMARY OF THE INVENTION

In view of the above problems, an object of the present invention is to provide a toner cartridge capable of suppressing the use of the toner cartridge beyond its lifetime due to excessive refilling of toner.

In order to accomplish the above object, a toner cartridge of the present invention has a housing which forms an internal space for housing toner to be fed to an image forming apparatus and which has a filling port for filling the internal space with the toner, a divider plate which is movably provided in the housing so as to be able to divide the internal space, and a fixing means which can fix the divider plate in a state of dividing the internal space.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1:
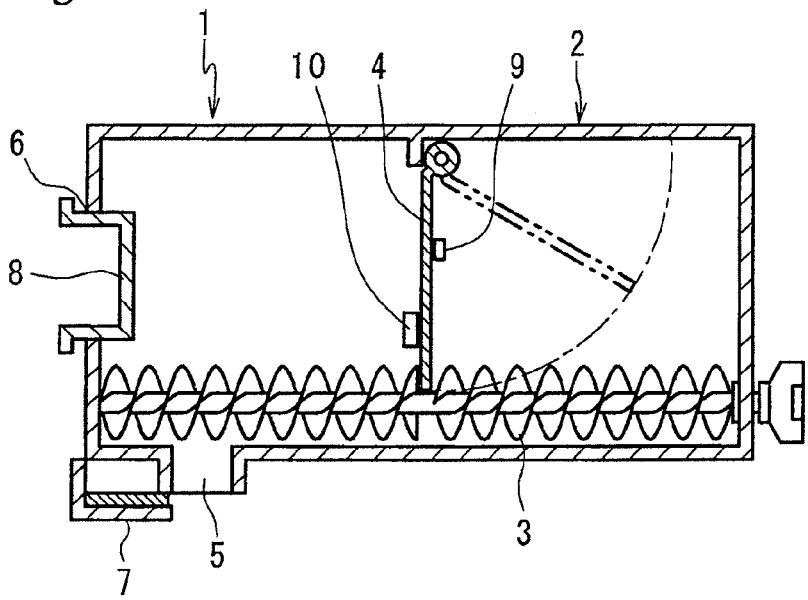
FIG. 1 is a cross sectional front view of a toner cartridge in a first embodiment of the present invention.
Figure 2:
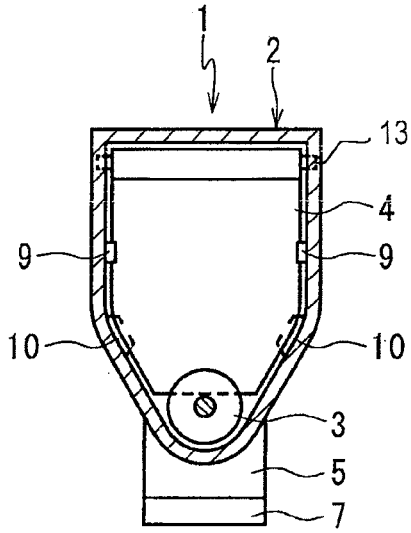
FIG. 2 is a cross sectional side view of the toner cartridge of FIG. 1.

FIGS. 1 and 2 show a toner cartridge 1 in a first embodiment of the present invention. The toner cartridge 1 includes a housing 2 which forms an internal space for housing toner (not shown), a feed screw 3 placed at the bottom of the housing 2 (the position which faces down in the state of being loaded onto an image forming apparatus), and a divider plate 4 pivotably supported in a swingable manner inside the housing 2.

A pin is formed on the divider plate 4 so as to project on each of both upper end sides, while a hinge hole (holding structure 13) into which the pin of the divider plate 4 fits is formed on the upper section of an inner wall of the housing 2. The divider plate 4 is so structured that its lower end reaches between screw teeth of the feed screw 3 in the state of being hung directly below and thereby divides the internal space of the housing 2 into two parts without interfering the shaft of the feed screw 3.

The housing 2 has a replenishing port 5 opened to the lower side of the feed screw 3 for feeding toner to the image forming apparatus, and a filling port 6 opened to the wall of a side end, where a projected area of the housing 2 becomes small, for filling the housing 2 with toner. The replenishing port 5 is sealed with a shutter 7 which is provided to be opened and closed, while the filling port 6 is sealed with a detachable cap 8.

The inner wall of the housing is provided with an engaging projection 9 which can stop the swinging divider plate 4 by coming into contact therewith and which can also be run over by the divider plate 4 and allows the divider plate 4 to swing upon application of strong force to the divider plate 4, and a stopper 10 which is formed to have a height too high for the divider plate 4 to run over and which can fit the divider plate 4 in between itself and the engaging projections 9 (the engaging projection 9 and the stopper 10 constitute a fixing means).

Figure 3:
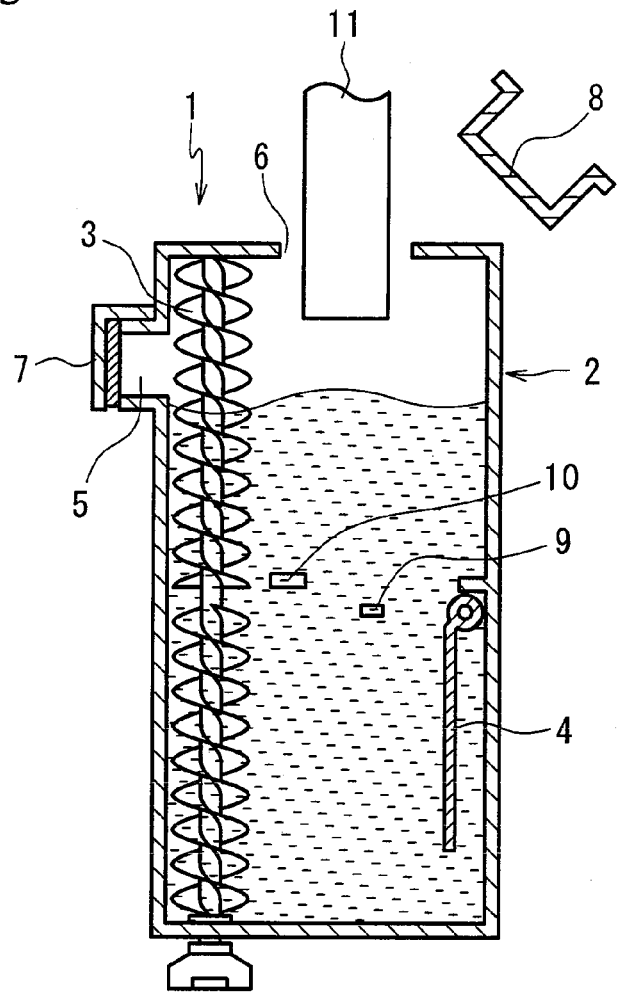
FIG. 3 is a cross sectional view showing the state of filling toner into the toner cartridge of FIG. 1.

First, the toner cartridge 1 is filled with toner, as shown in FIG. 3, by inserting a filling nozzle 11 into a filling port 6 with the filling port 6 facing up in the state that the divider plate 4 can freely swing without being fitted in between the engaging projection 9 and the stopper 10. In this regard, a dead space formed in the inside of the housing 2 by an angle of repose of toner is decreased by the filling port 6 being provided on the end face of the toner cartridge 1. The toner cartridge 1 filled with the toner has the filling port 6 sealed with the cap 8, and is provided to users.

Figure 4:
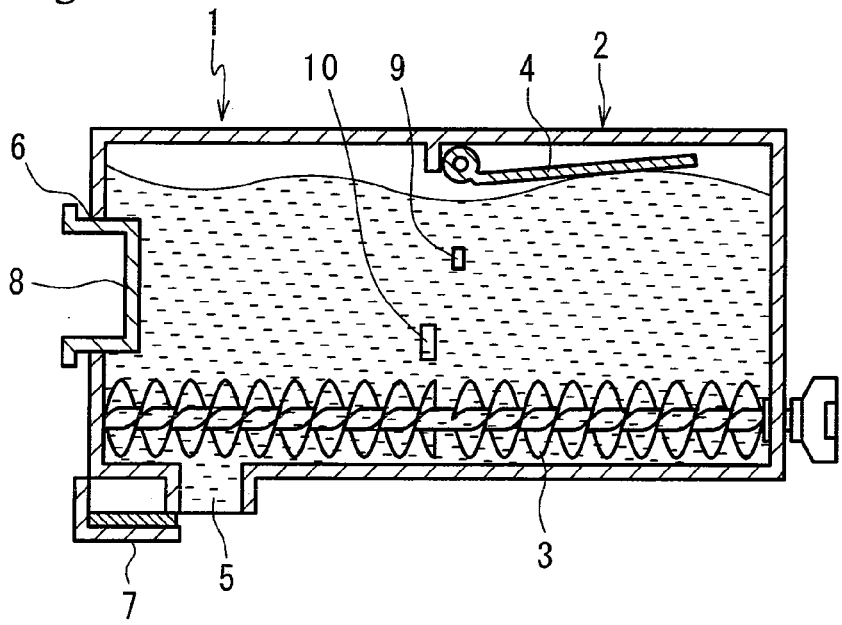
FIG. 4 is a cross sectional view of the toner cartridge of FIG. 1 when it is a brand new item.
Figure 5:
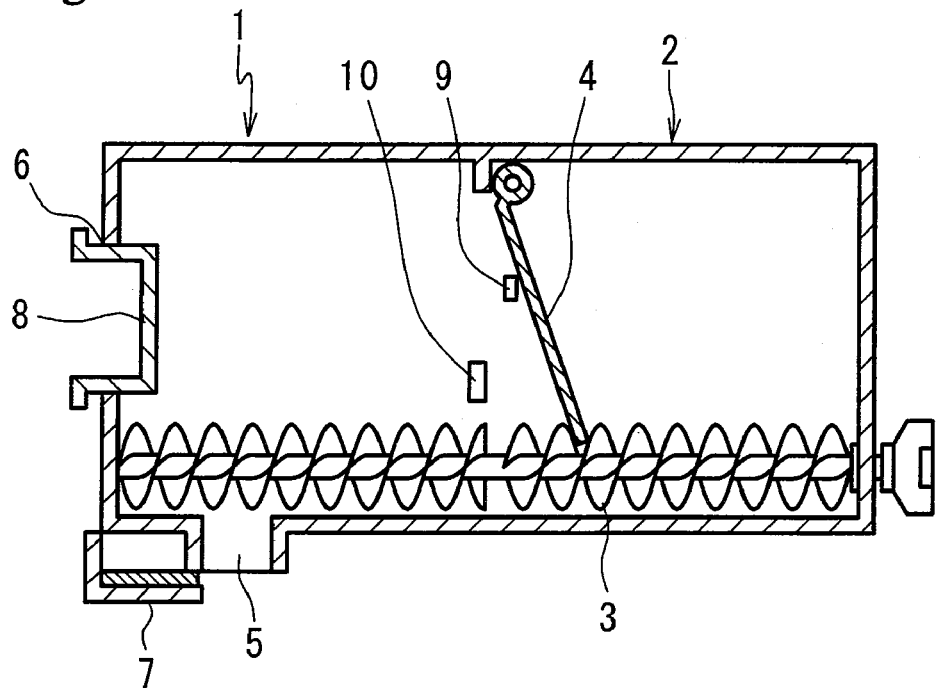
FIG. 5 is a cross sectional view of the toner cartridge of FIG. 1 during use.

As shown in FIG. 4, while a new toner cartridge 1 has the divider plate 4 in the state of being flapped up, the divider plate 4 rotates to hang down with its own weight as the toner is discharged. When the lower end of the divider plate 4 comes into contact with the screw 3, as shown in FIG. 5, the lower end of the divider plate 4 engages with the screw teeth of the feed screw 3. Then, the divider plate 4 is screw-fed by the feed screw 3, so that it runs over the engaging projection 9 to be fitted in between the engaging projection 9 and the stopper 10. The feed screw 3 has its screw teeth interrupted in the middle so as to prevent the divider plate 4 fitted between the engaging projection 9 and stopper 10 from being further screw-fed and pressed against the stopper 10 to cause breakage and overload.

Considerable force is required for the divider plate 4 to run over the engaging projection 9, and once the divider plate 4 is fitted in between the engaging projection 9 and the stopper 10, the divider plate 4 is fixed in the state where the internal space of the housing 2 is divided into two divided spaces, one space directly connected to the filling port 6 and the other space not directly connected to the filling port 6. Accordingly, even when the cap 8 of the toner cartridge 1 with the toner consumed is removed in order to fill the toner cartridge 1 with new toner, the toner cannot be filled into the divided space behind the divider plate 4, and therefore the amount of refilled toner is only about the half of the filling amount of toner when the cartridge is a brand new item.

This prevents filling of a large amount of toner which may lead to usage of the cartridge 1 far beyond the lifetime of a shaft seal member of the feed screw 3 and the like. Moreover, a period of time taken for the toner cartridge 1, which was refilled with toner for recycling, to be emptied is about half the time taken for the brand new cartridge to be emptied, so that a period of time till it is removed from the image forming apparatus is short. This increases opportunities for users to check the wear condition of the toner cartridge 1, making it easy to discover the early symptoms of wear such as a small amount of toner leakage.

Figure 6:
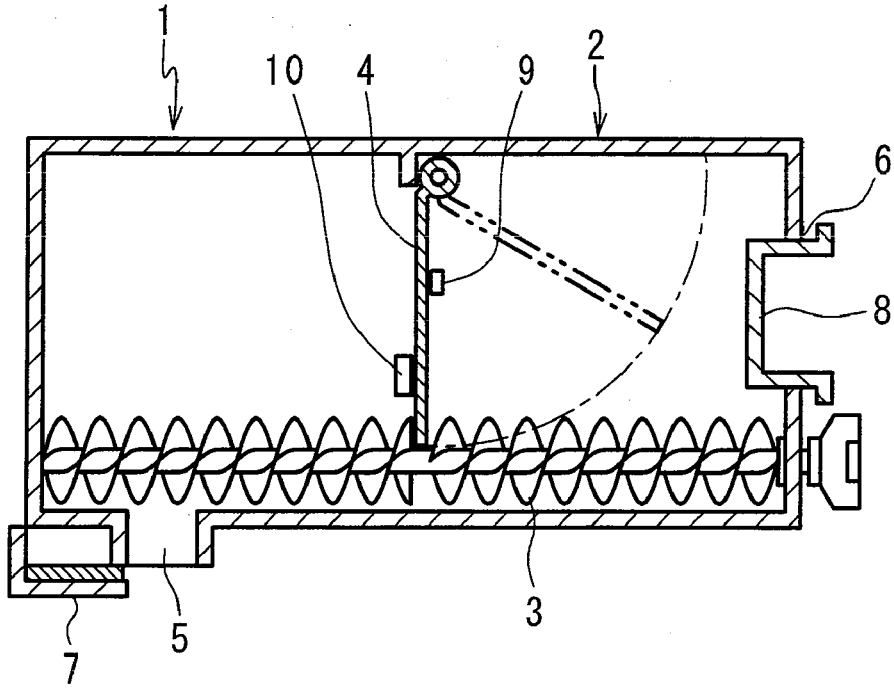
FIG. 6 is a cross sectional view of a toner cartridge in a second embodiment of the present invention.

Now FIG. 6 shows a toner cartridge 1 in a second embodiment of the present invention. In the following description, component members identical to those described before are designated by identical reference numerals to omit further explanation.

In the toner cartridge 1 of the present embodiment, a filling port 6 is provided on the side where the divider plate 4 swings, i.e., in the upstream of the moving direction of the divider plate 4 when the divider plate 4 fits in between the engaging projection 9 and the stopper 10.

Figure 7:
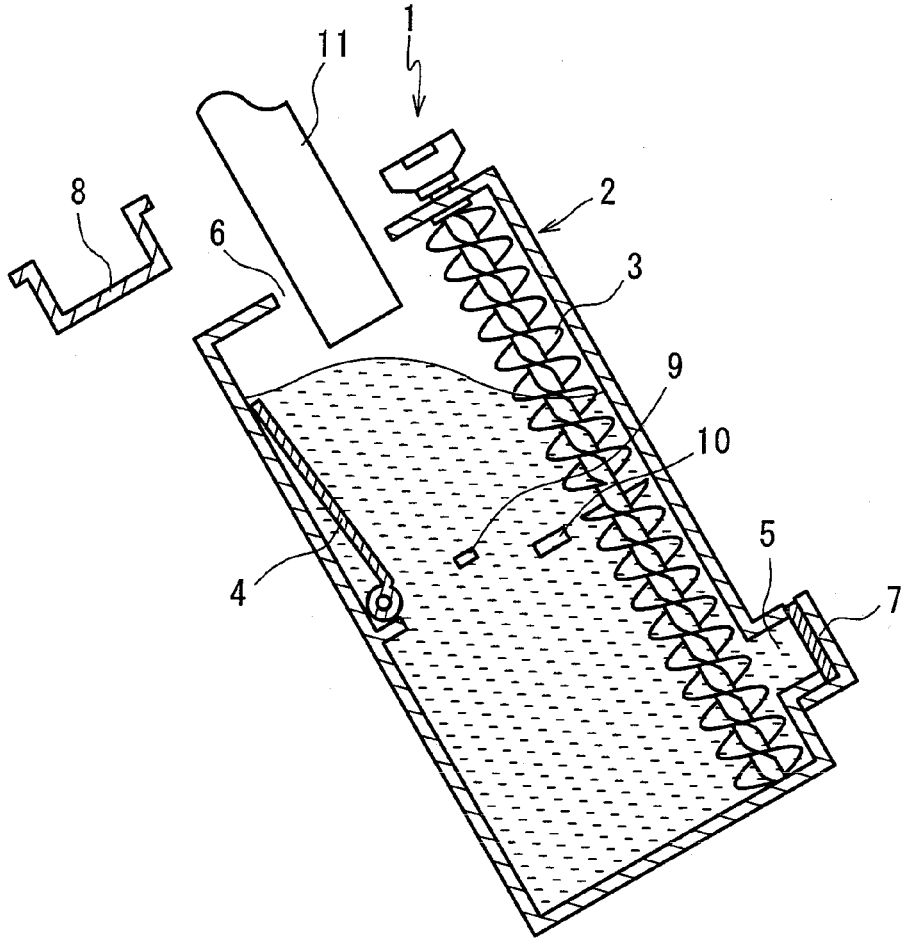
FIG. 7 is a cross sectional view showing the state of filling toner into the toner cartridge of FIG. 6.

In the present embodiment, it is required to fill the cartridge with toner in an inclined state, for example as shown in FIG. 7 so as to prevent the divider plate 4 from rotating with gravity to divide the internal space of the housing 2.

In the present embodiment, once the divider plate 4 fits in between the engaging projection 9 and the stopper 10, the divider plate 4 cannot rotate as it is supported by stopper 10 even when the filling nozzle 11 of the toner and other members are inserted into the housing 2 to press the divider plate 4 toward the back side for refilling of the toner, and therefore the state where the internal space of the housing 2 is divided into two divided spaces is maintained and refilling of the toner into the divided space on the rear side is prevented.

Figure 8:
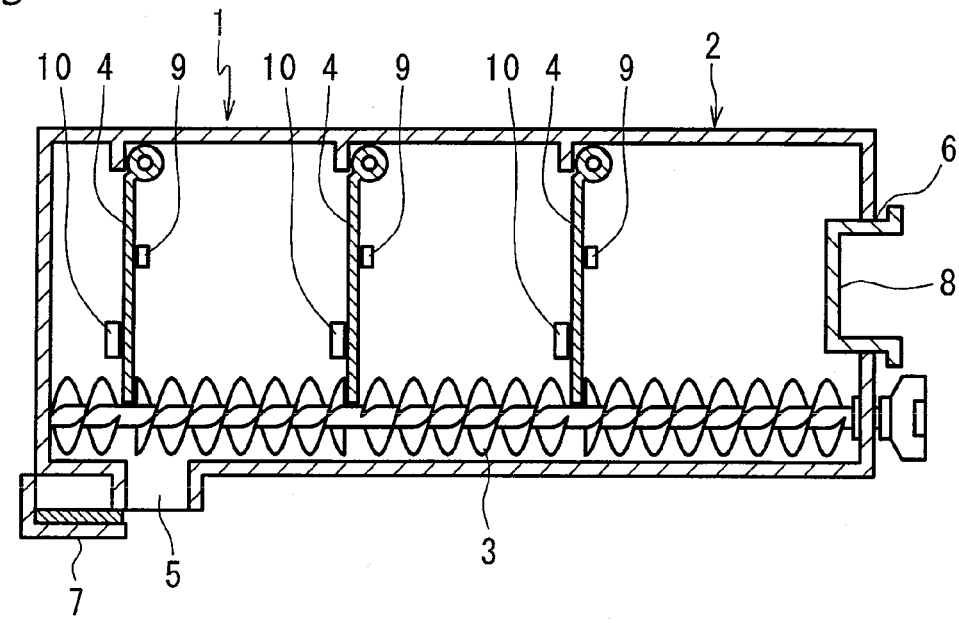
FIG. 8 is a cross sectional view of a toner cartridge in a third embodiment of the present invention.

Further, FIG. 8 shows a toner cartridge 1 in a third embodiment of the present invention. In the present embodiment, in the inside of housing 2, a plurality of divider plates 4 are pivotably supported, and an engaging projection 9 and a stopper 10 are each provided corresponding to the pivotably supported position of each divider plate 4 in order to fix each of the divider plates 4 in the state of dividing the internal space, respectively. Moreover, the screw teeth of the feed screw 3 are missing at positions corresponding to the pivotably supported positions of the respective divider plates 4 so that a load may not be added to each of the divider plates 4 which were fitted in between the engaging projection 9 and the stopper 10.

Consequently, even if a divider plate 4 is not able to be fixed between the engaging projection 9 and the stopper 10 for some reason, other divider plates 4 divide the internal space of the housing 2, so that in refilling of the toner cartridge 1 with toner, the filling-up of the toner cannot be carried out.

Moreover, in the present embodiment, in the case of changing a filling amount of toner at the time of manufacturing new toner cartridges 1, only one of the divider plates 4 may be attached in order to select the volume of an internal space sectioned on the filling port 6 side, so that the sum of an initial filling amount and a fillable toner amount for recycling is made generally equal to the lifetime of the cartridge 1.

Figure 9:
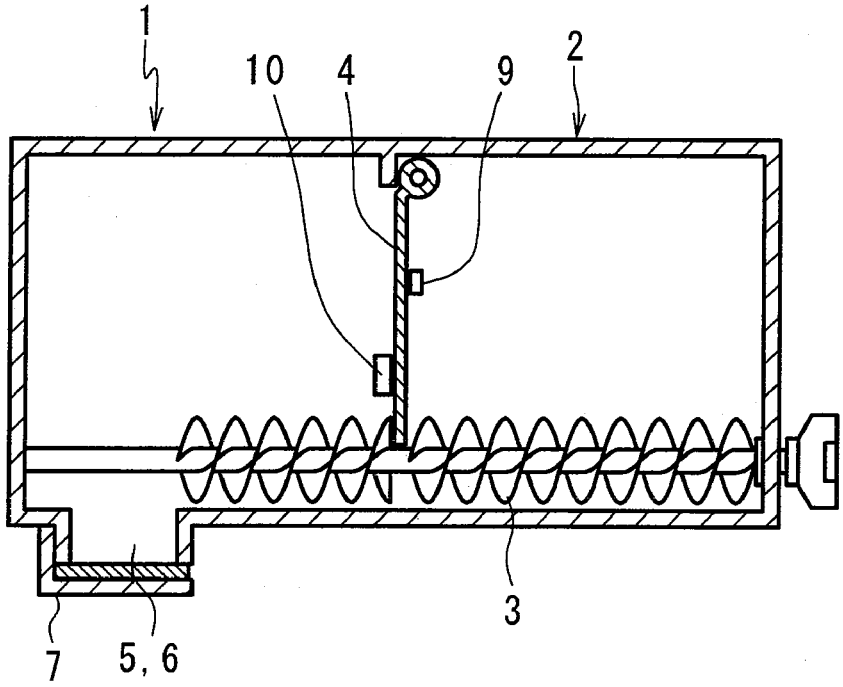
FIG. 9 is a cross sectional view of a toner cartridge in a fourth embodiment of the present invention.

Further, FIG. 9 shows a toner cartridge 1 in a fourth embodiment of the present invention. In the present embodiment, a filling port 6 for filling the housing 2 with toner also serves as a replenishing port 5 for feeding toner to an image forming apparatus. Accordingly, in the present embodiment, in order to facilitate filling of the housing 2 with toner, the feed screw 3 positioned above the replenishing port 5 (filling port 6) does not have screw teeth at its top end.

Figure 10:
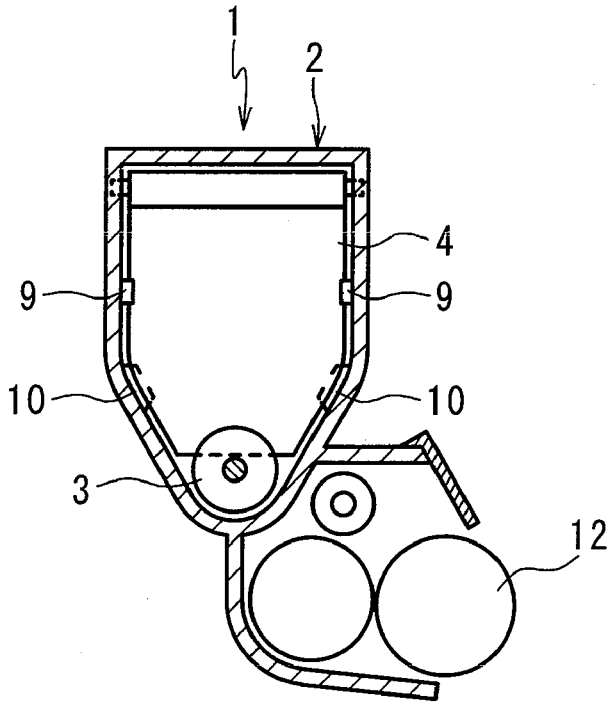
FIG. 10 is a cross sectional side view of a toner cartridge in a fifth embodiment of the present invention.

Further, as with the toner cartridge 1 of the fifth embodiment shown in FIG. 10, the present invention is also applicable to a type of toner cartridges incorporating a developing roller 12.

As described above, the toner cartridge in the present invention includes a housing which forms an internal space for housing toner to be fed to an image forming apparatus and which has a filling port for filling the internal space with the toner, a divider plate which is movably provided in the housing so as to be able to divide the internal space, and a fixing means which can fix the divider plate in a state of dividing the internal space.

According to this structure, dividing the internal space of the housing with a divider plate ensures that after the toner therein is consumed, toner is refilled only into one of the divided spaces. This makes it possible to set a refillable toner amount in consideration of the lifetime of the consumable items.

Also in the toner cartridge of the present invention, the fixing means may fix the divider plate with an operation of feeding the toner to the image forming apparatus.

According to this structure, it is not necessary to fix the divider plate at the time of manufacturing toner cartridges, which prevents the toner cartridges from becoming unnecessarily expensive.

The toner cartridge of the present invention may include a screw for feeding the toner to the image forming apparatus, and the divider plate may be fitted into the fixing means as the divider plate is screw-fed to the screw.

According to this structure, the divider plate is fixed by the torque of the screw, so that the divider plate can be secured firmly.

In the toner cartridge of the present invention, the divider plate may move so as to be away from the filling port and may be fixed by the fixing means.

According to this structure, the divider plate will not be detached from the fixing means by the pressure of toner during refilling of the toner or by being pressed by the toner filling nozzle.

The toner cartridge of the present invention may include a plurality of holding structures, each of which can movably hold the divider plate, and the fixing means may be provided in plural in conformity to a plurality of the holding structures.

According to this structure, the volume of the space which can be filled with toner at the time of refilling can be selected in response to the initial filling amount of the toner.

In the toner cartridge of the present invention, the divider plate may be provided in plural so as to be able to divide the internal space into three or more parts.

According to this structure, even if fixation of one of the divider plates by the fixing means is imperfect, the internal space can still be divided by other divider plates, making it possible to control the refilling amount of the toner.

In the toner cartridge of the present invention, among the divided spaces formed by the divider plate dividing the internal space, the divided space having the filling port may have a volume equal to or less than half of the entire internal space.

According to this structure, when the lifetime of consumable items is only about 1.5 times the initial filling amount of the toner, the refilling amount of the toner can appropriately be controlled.

In the toner cartridge of the present invention, the filling port may be provided in an end face where a projected area of the housing becomes small.

According to this structure, it becomes possible to decrease the dead space by an angle of repose of toner when the toner is filled with the filling port facing up.

In the toner cartridge of the present invention, the filling port may serve also as a replenishing port for feeding the toner to the image forming apparatus.

According to this structure, the opening of the housing may be decreased advantageously.

Thus, according to the present invention, dividing the internal space of the housing by a divider plate makes it possible to provide a toner cartridge capable of suppressing the use of the toner cartridge beyond the lifetime of consumable items due to refilling of a large amount of toner.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

The invention claimed is:

1. A toner cartridge, comprising:

a housing which forms an internal space for housing toner to be fed to an image forming apparatus and which has a filling port for filling the internal space with the toner;

a divider plate which is movably provided in the housing so as to be able to divide the internal space;

a fixing portion which can fix the divider plate in a state of dividing the internal space; and a screw for feeding the toner to the image forming apparatus, wherein the divider plate is fitted into the fixing portion as the divider plate is screw-fed to the screw.

2. The toner cartridge according to claim 1, wherein the fixing portion fixes the divider plate with an operation of feeding the toner to the image forming apparatus.

3. The toner cartridge according to claim 1, wherein the divider plate moves so as to be away from the filling port and is fixed by the fixing portion.

4. The toner cartridge according to claim 1, comprising a plurality of holding structures, each of which can movably hold the divider plate, wherein the fixing portion is provided in plural in conformity to a plurality of the holding structures.

5. The toner cartridge according to claim 4, wherein the divider plate is provided in plural so as to be able to divide the internal space into three or more parts.

6. The toner cartridge according to claim 1, wherein among the divided spaces formed by the divider plate dividing the internal space, the divided space having the filling port has a volume equal to or less than half of the entire internal space.

7. The toner cartridge according to claim 1, wherein the filling port is provided in an end face where a projected area of the housing becomes small.

8. The toner cartridge according to claim 1, wherein the filling port serves also as a replenishing port for feeding the toner to the image forming apparatus.

* * * * *